United States Patent [19]

Ballinger et al.

[11] Patent Number: 4,875,685

[45] Date of Patent: Oct. 24, 1989

[54] GOLF PRACTICE APPARATUS

[76] Inventors: Kedric L. Ballinger, 1337 W. Till Rd.; Robert A. Dornbush, Sr., 1411 Rabus Dr., both of Fort Wayne, Ind. 46825

[21] Appl. No.: 177,533

[22] Filed: Apr. 1, 1988

[51] Int. Cl.[4] ..... A63B 69/36; A63B 57/00

[52] U.S. Cl. ..... 273/195 B; 273/201

[58] Field of Search ..... 273/195 R, 195 A, 195 B, 273/176 K, 176 H, 197 R, 201, 182 R, 186 R, 186 C, 183 R, 183 A, 176 R–176 G; 124/45, 49, 50, 51 R; 221/289, 194, 192; 272/69; 206/579, 315.1; 198/814, 808, 861.3, 813

[56] References Cited

U.S. PATENT DOCUMENTS

| | | | |
|---|---|---|---|
| 2,955,701 | 10/1960 | Schwertl | 198/814 |
| 3,459,107 | 8/1969 | Anderson et al. | 273/33 |
| 3,622,161 | 11/1971 | Keppen | 273/186 R |
| 3,639,923 | 2/1972 | Stewart | 273/187 R |
| 3,653,715 | 4/1972 | Drabert et al. | 272/69 |
| 3,712,628 | 1/1973 | Boss, Jr. | 273/195 A |
| 3,756,606 | 9/1973 | Land | 273/182 R |
| 3,765,683 | 10/1973 | Landry | 273/198 |
| 3,944,232 | 3/1976 | Tierney | 206/315.1 X |
| 4,331,332 | 5/1982 | Hughes | 273/195 B |
| 4,360,204 | 11/1982 | Karr | 273/201 |
| 4,575,092 | 3/1986 | Watson | 273/201 |
| 4,741,537 | 5/1988 | Adam | 273/201 |

FOREIGN PATENT DOCUMENTS

| | | | |
|---|---|---|---|
| 2068740 | 8/1981 | United Kingdom | 273/195 R |

*Primary Examiner*—Edward M. Coven
*Assistant Examiner*—S. Passaniti
*Attorney, Agent, or Firm*—Richard L. Robinson

[57] ABSTRACT

A golf practice apparatus simulates the response of natural turf to the impact of a golf club head during a conventional golf club swing. The apparatus includes a platform for the golfer to stand on, a main frame connected to the platform adjacent thereto, and an inner frame carrying an upper surface mounted within the main frame and connected thereto such that the rearward end of the inner frame can translate forwardly and the forward end of the inner frame can translate initially forwardly and thence downwardly in a generally arcuate path when the upper surface is impacted by the golf club head. The platform is configured as a hinged box which can be folded together to form a closed case in which the main frame and associated components can be stored. A ball storage ramp including a golf club head actuable ball filter is removably attachable to the main frame.

17 Claims, 8 Drawing Sheets

GOLF PRACTICE APPARATUS

BACKGROUND OF THE INVENTION

The present invention relates generally to devices for practicing one's golf swing and more particularly to a golf practice apparatus which simulates the response of natural turf to the impact of the golf club head therewith during a swing.

Repetitive practice of one's golf swing, whether in the home back yard or at a commercial driving range, can have an extremely deleterious effect on the turf. This is especially true in the case of iron shots because a properly executed iron shot by its nature will cause the removal of a small patch of turf known as a divot. This is not normally a problem on the golf course where the iron shots will be taken from randomly distributed lies over a fairly large area of the fairway. During practice, however, a large number of successive iron shots taken from a small area of turf would soon render the turf barren, which is not only unsightly but also results in the practice spot not providing a natural response to the impact of the club head. Consequently, one does not obtain the proper feel during the swing nor does the golf ball travel in a trajectory which is properly indicative of the quality of the swing.

A conventional solution to the problem of practicing iron shots which has been used at driving ranges is the provision of a mat having a tough but unyielding surface. This solution provides a consistent surface from which to hit the ball, but the surface does not simulate the response of natural turf to either well executed or poorly executed swings. Such mats can result in development of bad swing habits since an improperly executed swing which scoops the ball up off the mat will have a better feel than a properly executed swing wherein one hits down into the mat at the point of contact with the ball.

A better proposed solution is the device described in U.S. Pat. No. 3,712,628 to Boss, Jr. which includes a rigid housing containing horizontally mounted rollers which support an endless belt having grass simulating bristles on its outer surface. A padded platform beneath the upper portion of the belt is mounted so as to pivot about one end and is held against the inner surface of the belt by an elastic supporting member at the other end. The rollers are designed to minimize their resistance to acceleration resulting from the tangential forces imparted by the belt. The uppermost surface of the padded platform is made smooth to minimize friction between the belt and pad allowing translation of the belt across the platform following impact of the golf club head. As the golf club head strikes the belt, the vertical energy component is transferred from the belt to the platform and then to the elastic supporting member which yields permitting the platform to pivot downwardly. The belt simultaneously translates forwardly as it moves about the rollers due to the horizontal energy component transmitted to it by the club head. The combined downward and forward deflections of the belt momentarily forms a pocket in the belt simulating that left by a removed divot.

One disadvantage of the device shown in Boss, Jr. is that it is too forgiving of certain types of bad golf swings, particularly one known as a "fat shot", and therefore does not provide feedback to the golfer that his swing was poorly executed. A "fat shot" is one in which the club head hits downwardly toward the ball at approximately the correct angle but the club head catches the turf before hitting the ball. Consequently, there is a buildup of turf between the ball and the club head which makes the ball travel a lesser distance than it would if the swing were executed properly. The fatter the shot the less distance the ball travels. With the Boss, Jr. device a club head which, for example, impacts the belt an inch behind the ball would cause the belt and platform to pivot downwardly immediately upon contact of the golf club head with the belt and the belt would immediately translate forwardly offering little resistance to the club head, thereby allowing the club head to move easily forward into contact with the ball without simulating the buildup of turf that would occur if such a swing were executed on a natural surface.

It would be desirable to provide a golf practice apparatus which not only allows the golf club head to move down and under the ball on the follow through of the swing but which also simulates the response of natural turf to a fat shot, thereby providing feedback to the golfer to indicate that his swing was not executed properly.

SUMMARY OF THE INVENTION

The present invention provides a golf practice apparatus which provides an improved simulation of the response of natural turf to the impact of a golf club head thereon. The surface which supports the golf ball is mounted such that the surface must move initially forwardly before moving downwardly in response to an impact by a golf club head. Furthermore, the surface which is struck by the golf club head does not translate forwardly by free rotation about rollers with each shot as in the Boss, Jr. device. Rather, forward translation of the surface is resisted by resilient bias means which also returns the surface to its original position after the shot.

Simulation of the response of natural turf to a fat shot is provided in the present invention in part by a mounting system for the surface in which the forward end of the surface is constrained to move initially forwardly and thence downwardly in a generally arcuate path, and the rearward end of the surface is constrained to move forwardly against rearwardly directed resilient bias. Consequently, when the club head first engages the surface the initial portion of the swing follow-through causes a wrinkle to be formed in the surface in front of the club head which resists the forward movement of the club head. The club head in engagement with the wrinkle causes a generally forward movement of the surface during the final portion of the swing follow-through. After the ball has been hit, the surface pivots downwardly to get out of the way so that neither the golf club head nor the mat is damaged as the swing follow-through is completed. Furthermore, because the surface is constrained against free forward translation in contrast to the Boss, Jr. device, if the club head contacts the mat before hitting the ball then the wrinkle formed in the surface ahead of the club head is intermediate the club head and the ball. This wrinkle reduces the amount of energy imparted to the golf ball, thereby decreasing the distance of the shot so that the golfer knows that he has not executed a clean shot.

The invention, in one aspect thereof, provides a golf practice apparatus for simulating the response of natural turf to the impact of a golf club head during a conventional golf club swing. The apparatus includes a frame and an upper surface having a forward end and a rearward end. Means are provided for connecting the rearward end of the upper surface to the frame such that the rearward end can translate forwardly when the upper surface is impacted by the golf club head and further means are provided for connecting the forward end of the upper surface to the frame such that the forward end can translate initially forwardly and thence downwardly in a generally arcuate path when the upper surface is impacted by the golf club head.

Another aspect of the present invention involves a golf practice apparatus including a frame and a continuous belt loop having a forward end and a rearward end and a horizontally oriented turf simulating upper surface. Means are provided for connecting the belt loop to the frame, and further means are provided for maintaining the belt loop taut. The belt loop tightening means includes a forward member and a rearward member in engagement with the forward end and the rearward end of the belt loop, respectively, and further includes foldable means for biasing the forward member and the rearward member apart and for selectively unbiasing the forward member and rearward member to permit removal of the belt loop therefrom.

Yet another aspect of the present invention involves a portable golf practice apparatus including a platform configured as open sided boxes hinged together such that the open sides thereof can be pivoted together converting the platform to a closed case. A fairway turf simulating component is removably attachable to the platform and is sized and configured to be stored inside the platform when the platform is configured as a closed case.

A further aspect of the present invention involves a golf practice apparatus for simulating the response of natural turf to the impact of a golf club head during a conventional golf club swing. The apparatus includes a main frame and an inner frame having a forward end and a rearward end, the inner frame disposed within the main frame, the inner frame carrying an upper surface, the rearward end being pivotally and slidingly connected to the main frame, the forward end being pivotally connected to the main frame via a hinge arm extending downwardly from the inner frame. Means are provided for biasing the inner frame rearwardly with respect to the main frame such that the rearward end of the inner frame translates forwardly and the forward end of the inner frame translates initially forwardly and then downwardly in a generally arcuate path when the upper surface is impacted by the golf club head. A ball storage ramp is provided adjacent the upper surface. The ball storage ramp includes a reservoir area removably attached to the main frame and sloping generally downwardly to a lowest point. A ball lifter means is hinged to the ball storage ramp proximate the lowest point for receiving and lifting the golf ball above the upper surface and delivering the golf ball onto the upper surface. The ball lifter means is actuable by a golf club head.

One advantage of the present invention is the provision of a golf practice apparatus having an artificial surface which simulates the response of natural turf to the impact of a golf club head, especially when the golf club swing is executed poorly as in a "fat shot". Other advantages of the invention will become apparent from the following description and drawings.

DETAILED DESCRIPTION OF THE PREFERRED EMBODIMENT

Figure 1:
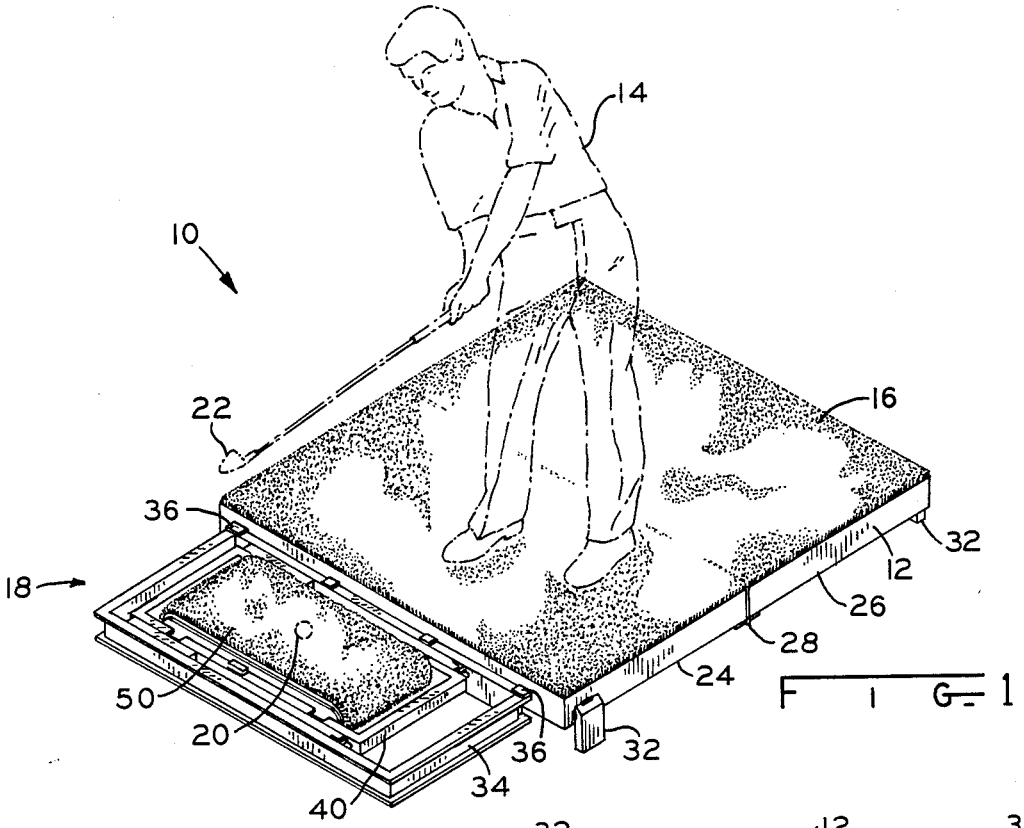
FIG. 1 is a perspective view of a golf practice apparatus in accordance with the present invention.
Figure 2:
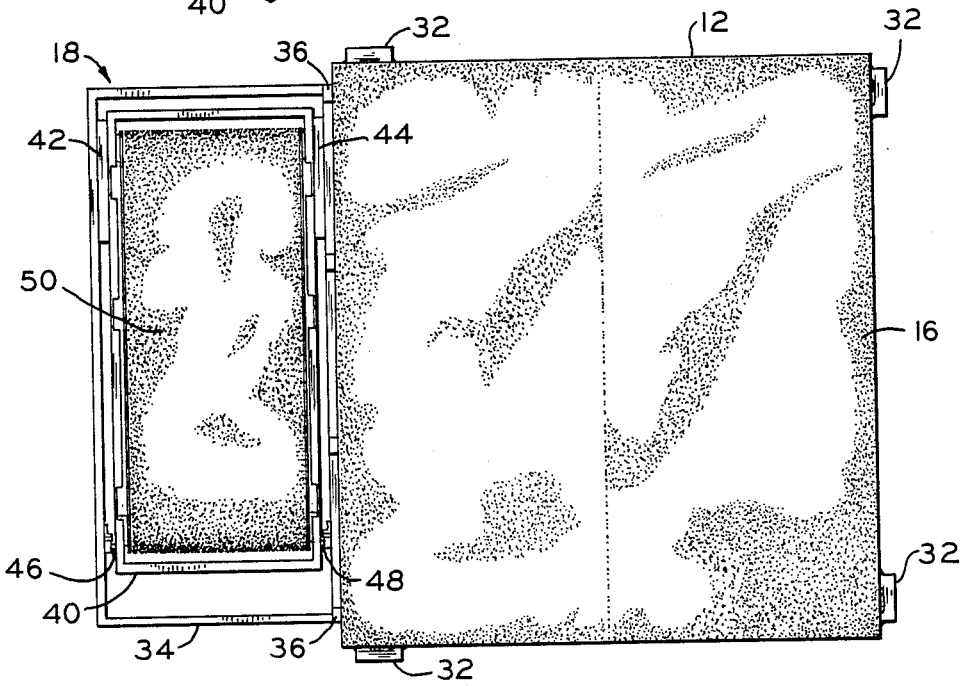
FIG. 2 is a plan view of the golf practice apparatus of FIG. 1.
Figure 3:
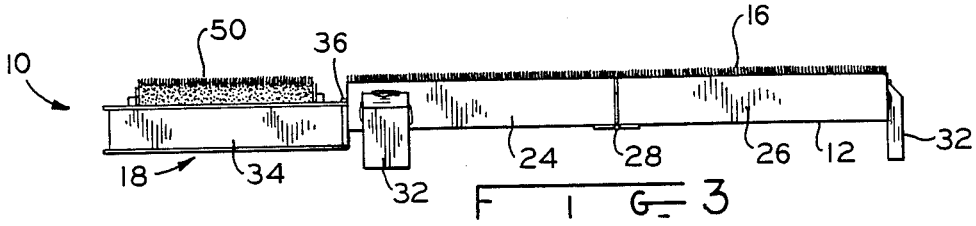
FIG. 3 is an elevational view of the golf practice apparatus of FIG. 1.
Figure 4:
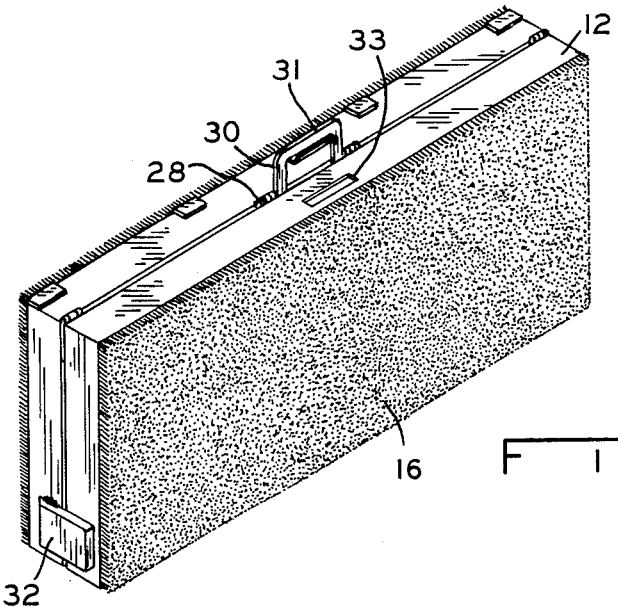
FIG. 4 is a perspective view of the golf practice apparatus of FIG. 1, particularly showing the platform of the apparatus folded and closed with a carrying handle extended.
Figure 5:
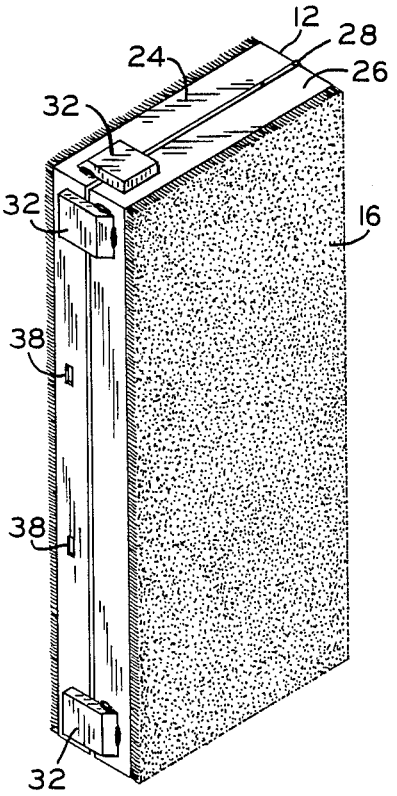
FIG. 5 is a perspective view of the golf practice apparatus of FIG. 1, showing another view of the platform when folded closed.
Figure 6:
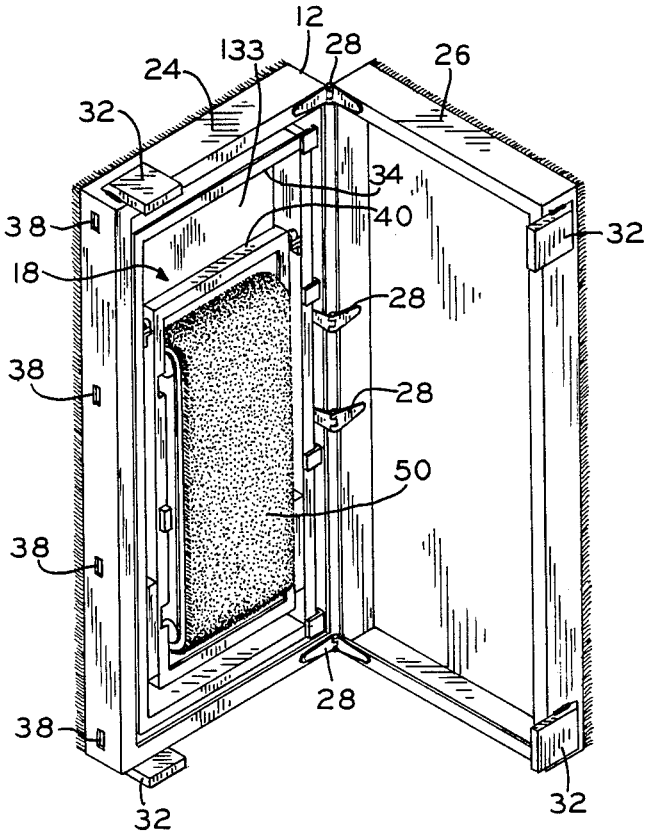
FIG. 6 is a perspective view of the golf practice apparatus of FIG. 1, particularly showing the platform partially folded and revealing a fairway turf simulating component stored therein.
Figure 7:
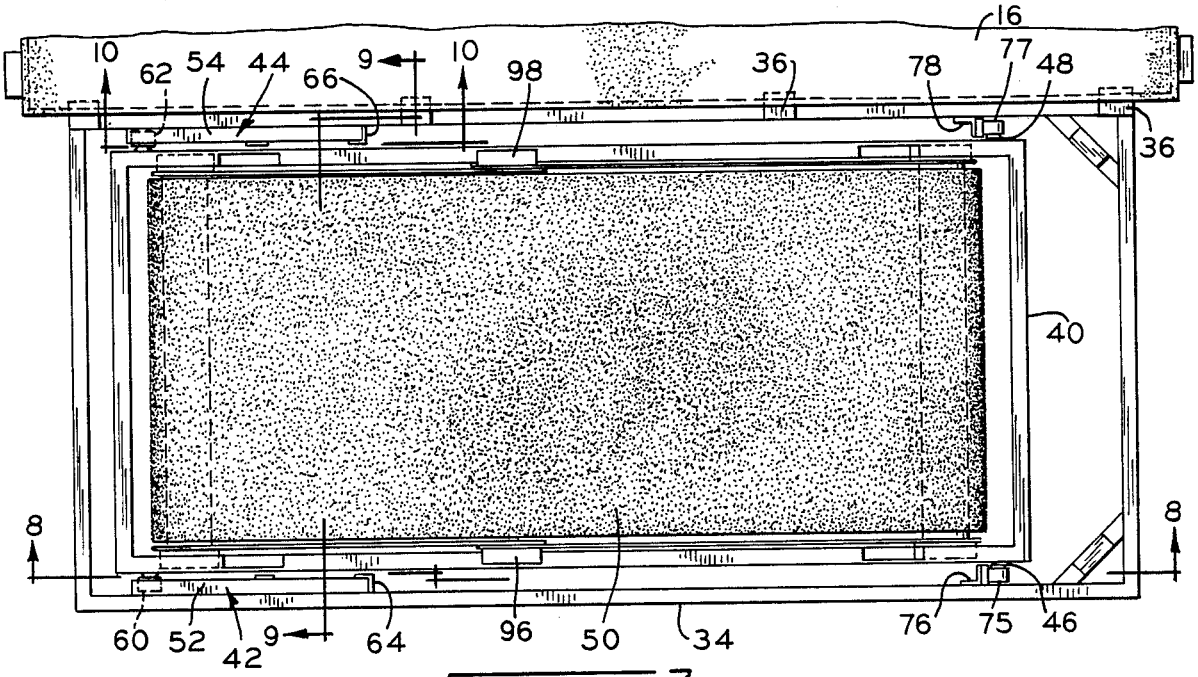
FIG. 7 is an enlarged plan view of a portion of the golf practice apparatus of FIG. 1, namely the fairway turf simulating component.
Figure 8:
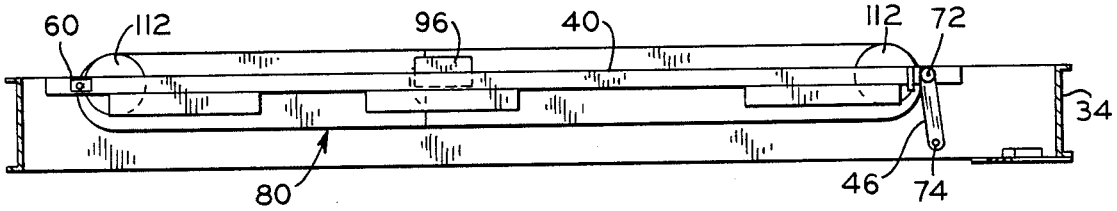
FIG. 8 is a sectional view of the portion of the golf practice apparatus of FIG. 1 shown in FIG. 7, taken along section line 8—8 and looking in the direction of the arrows.
Figure 9:
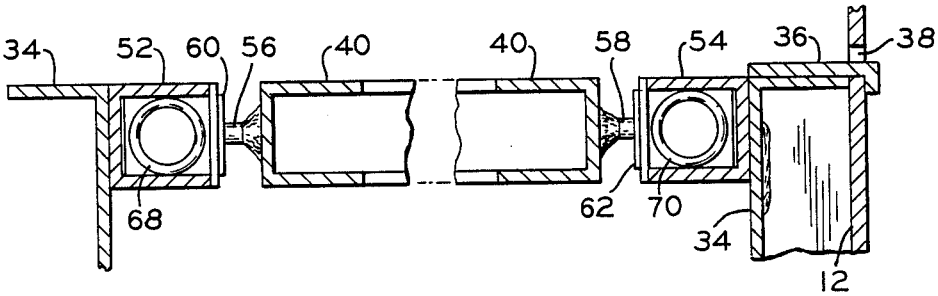
FIG. 9 is a sectional view of the portion of the golf practice apparatus of FIG. 1 shown in FIG. 7, taken along section line 9—9 and looking in the direction of the arrows.
Figure 10:
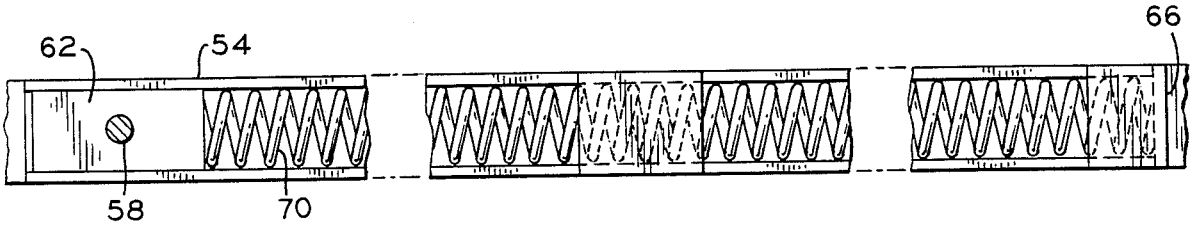
FIG. 10 is a sectional view of the portion of the golf practice apparatus of FIG. 1 shown in FIG. 7, taken along section line 10—10 and looking in the direction of the arrows.
Figure 11:
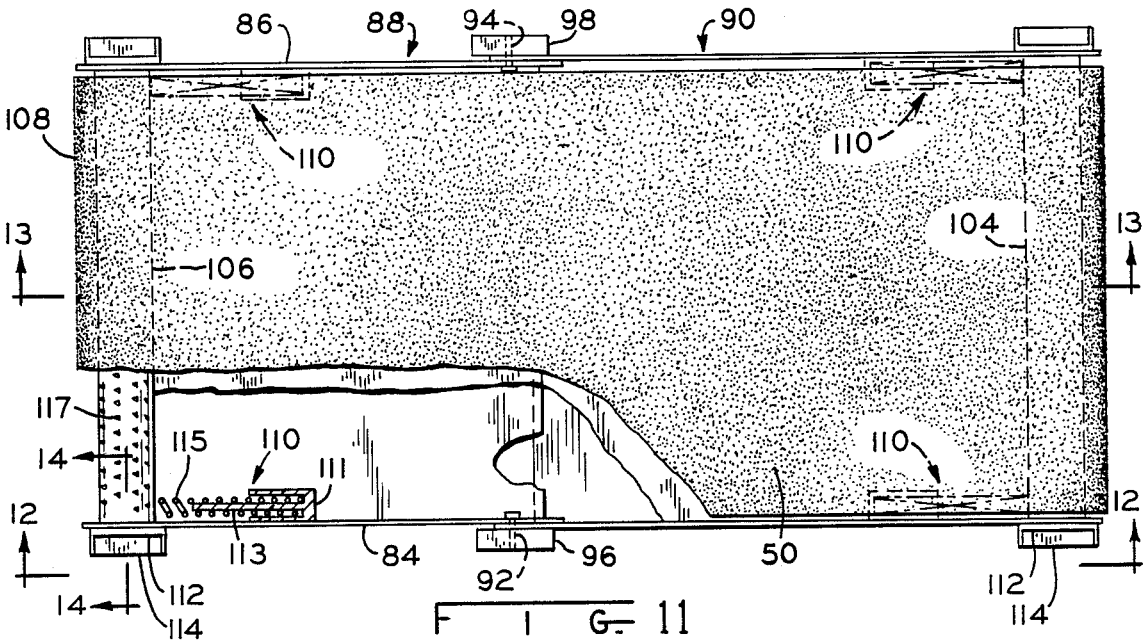
FIG. 11 is an enlarged, partially cut-away, plan view of a part of the portion of the golf practice apparatus of FIG. 1 shown in FIG. 7.
Figure 12:
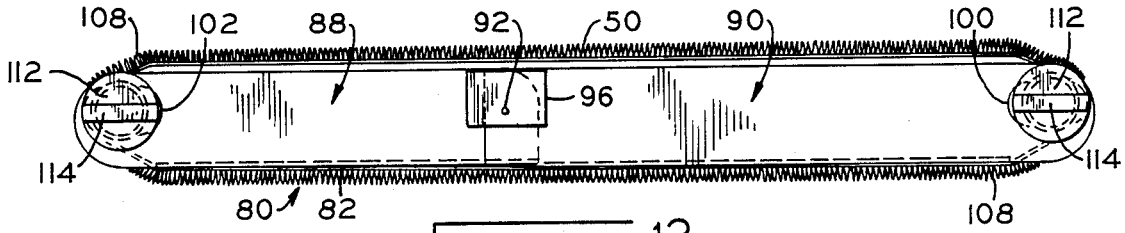
FIG. 12 is a sectional view of the part of the golf practice apparatus of FIG. 1 shown in FIG. 11, taken along section line 12—12 and looking in the direction of the arrows.
Figure 13:
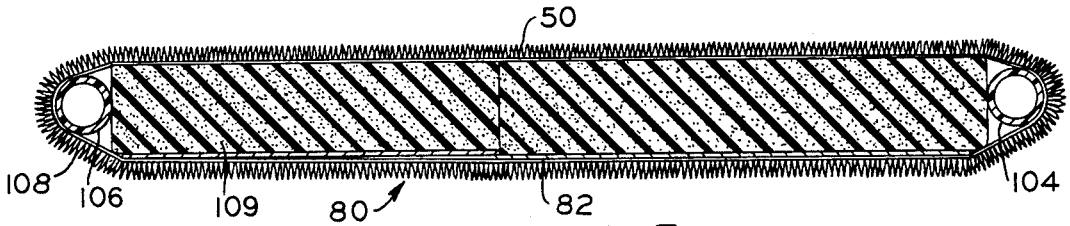
FIG. 13 is a sectional view of the part of the golf practice apparatus of FIG. 1 shown in FIG. 11, taken along section line 13—13 and looking in the direction of the arrows.
Figure 14:
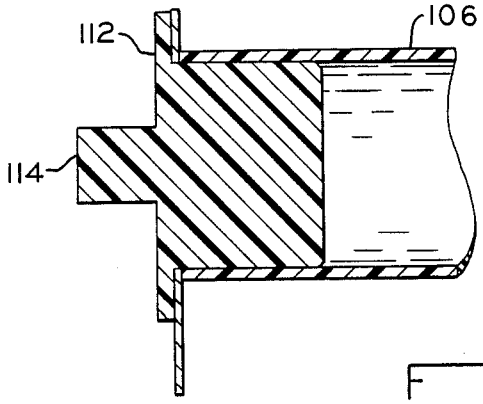
FIG. 14 is a sectional view of the part of the golf practice apparatus of FIG. 1 shown in FIG. 11, taken along section line 14—14 and looking in the direction of the arrows.

Referring in particular to FIGS. 1–3, there is illustrated a golf practice apparatus 10 in accordance with the present invention. Golf practice apparatus 10 includes a platform 12 upon which a golfer 14 can stand. The upper surface of platform 12 is covered with a bristled artificial turf 16 which allows the user to practice while wearing street shoes without slipping. Adjacent platform 12 and connected thereto is a fairway turf simulating component 18. Component 18 supports a golf ball 20 positioned to be struck by a golf club head 22. Platform 12 is configured as two separate five-sided boxes 24 and 26 with the open side of each facing downward. The two boxes 24 and 26 are hinged together by hinges 28 and resemble an inverted open suitcase. As illustrated in FIGS. 4–6, platform 12 folds together to form a container in which the fairway turf simulating component 18 can be stored. At the hinge line of platform 12 there is provided a handle 30 for ease of transportation of the entire assembly. Handle 30 is provided with a hand-fitting curved flange 31 for carrying comfort. Flange 31 is received in slot 33 when platform 12 is opened. Four legs 32 are attached to the sides of platform 12 proximate the corners thereof in order to elevate platform 12 to a convenient height and also to provide alignment guides when platform 12 is folded up as shown in FIGS. 4–6.

Platform 12 together with turf simulating component 18 provide a complete, easily transported and stored golf practice apparatus which can be used conveniently on virtually any available surface. Platform 12, besides functioning as a transportation and storage case, also allows the user to be elevated at the proper height with respect to the turf simulating component 18. Otherwise, turf simulating component 18 would have to be recessed in the ground which would negate the portability advantage. Nevertheless, the turf simulating component 18 could be used alone in a permanent or semi-permanent recessed installation if so desired, where portability is not a primary concern, such as at a commercial driving range.

Referring again to FIGS. 1–3, fairway turf simulating component 18 includes a four-sided rectangular main outer frame 34 which is attached along one side thereof to platform 12 by four L-shaped cleats 36 which are received in four corresponding slots 38 in one sidewall of platform 12 (See FIGS. 5 and 6). Disposed within main outer frame 34 is an inner frame 40 which is four-sided and rectangular in shape and has a width dimension less than the width dimension of outer frame 34 and a length dimension less than the length dimension of outer frame 34. Inner frame 40 is supported with respect to outer frame 34 at the rearward end by spring loaded hinges 42 and 44 that allow inner frame 40 to move horizontally forward and also pivot downwardly about hinges 42 and 44 and thereafter return to the original starting position. Spring loaded hinges 42 and 44 can be provided with means for damping the return of inner frame 40, if desired. Inner frame 40 is supported at the forward end by hinge arms 46 and 48 which allow inner frame 40 to move initially forward horizontally with respect to outer frame 34 and then downwardly in an arcuate path. Inner frame 40 supports a turf simulating upper surface 50 which moves with inner frame 40 when struck by golf club 22.

Referring in particular to FIGS. 7–10, there is illustrated an enlarged plan view of main outer frame 34 and inner frame 40 and the associated components. Each of the sides of outer frame 34 is a U-shaped aluminum channel with the opening of each channel facing outwardly of the frame. Inner frame 40 is likewise constructed of four side members comprising U-shaped channels, but the opening of each channel member faces inwardly of frame 40. Fixed to the interior surfaces of outer frame 34 at the rear end thereof and forming part of spring loaded hinges 42 and 44 are U-shaped channels 52 and 54 whose channel openings face inwardly of outer frame 34 toward inner frame 40. Extending transversely outwardly of inner frame 40 at the rearward end thereof are trunnion pins 56 and 58 which are fixed to inner frame 40 and which are pivotally mounted within carriage blocks 60 and 62. Carriage blocks 60 and 62 are slidingly received in channels 52 and 54, respectively. Disposed within channels 52 and 54 intermediate carriage blocks 62 and forward end stops 64 and 66 are compression coil springs 70.

At the forward end of inner frame 40 is located hinge arms 46 and 48 which are pivotally connected at the upper end 72 to inner frame 40 and at the lower end 74 to outer frame 34. When carriage blocks 60 and 62 are at their rearmost positions, hinge arms 46 and 48 are oriented approximately vertically and bumpers 75 and 77 at the upper end 72 of hinge arms 46 and 48, respectively, are in engagement with pivot stops 76 and 78 which are fixed to outer frame 34. As inner frame 40 moves forwardly with respect to outer frame 34 against the spring resistance of coil springs 68 and 70, the forward end of inner frame 40 initially moves horizontally forwardly and then downwardly in an arcuate path about pivot 74. At the same time rear carriage blocks 60 and 62 move forwardly in a horizontal path with the rearward end of inner frame 40 pivoting about trunnion pins 56 and 58 as the forward end of inner frame 40 moves downwardly about pivot 74.

Secured within inner frame 40 is turf simulating upper surface 50 and associated components which are described in greater detail below with reference to FIGS. 11–15. Disposed interiorly of inner frame 40 is a pan-like tray 80 having a bottom wall 82 and sidewalls 84 and 86. Tray 80 is configured in two sections 88 and 90 which are connected together via hinge pins 92 and 94 which are attached to guide blocks 96 and 98, respectively. At the forward and rearward ends respectively of sidewalls 84 and 86 are elongate holes 100 and 102. Received transversely through the forward elongate holes 100 and rearward elongate holes 102 of tray 80 are tubular members 104 and 106, respectively. Wrapped around tubular member 104 and 106 and extending therebetween is a continuous belt 108 having upstanding bristles which constitute an artificial turf surface, the upper surface of which comprises turf simulating upper surface 50. Disposed within tray 80 is a pad 109 of resilient-type material such as foam rubber or other elastomeric material which supports the upper flight of continuous belt 108 and which also serves to absorb the shock of the impact of club head 22 on turf simulating surface 50. Belt 108 is under tension due to four compression spring assemblies 110 mounted to the inner surfaces of sidewalls 84 and 86 of tray 80 which bear upon tubular members 104 and 106, biasing them apart from one another. Spring assembly 110 includes bracket 111 and rod 113 attached, for instance, to sidewall 84. A compression coil spring 115 is disposed coaxially about rod 113 and engages bracket 111 at one end and tubular member 106, for instance, at the other end. Elongate holes 100 and 102 allow for slight movement of tubular members 104 and 106 toward each other when additional tension is applied to the upper flight of belt 108 upon impact by the golf club head 22. Pins 117 are provided on the surface of tubular member 106 which engage and grip the underside of belt 108 to prevent slippage of the upper flight of belt 108 with respect to tubular member 106 in the forward direction, i.e., from member 106 toward member 104. For this purpose, pins 117 are disposed on member 106 to point in a direction counter to the direction in which belt 108 is urged upon impact by golf club head 22. It is to be noted that due to the tension provided in belt 108 by springs 110 and due to the friction between belt 108 and tubular members 104 and 106, particularly provided by pins 117 on member 106, as well as friction between the inner surface of belt 108 and the resilient pad 109 within tray 80, belt 108 does not freely translate about tubular members 104 and 106. Furthermore, tubular members 104 and 106 are not configured as rollers inasmuch as each is provided with an end piece 112 having a rectangular extension 114 which is received within the channels of the side members of inner frame 40 so as to prevent rotation of tubular members 104 and 106 with respect to inner frame 40.

Figure 15:
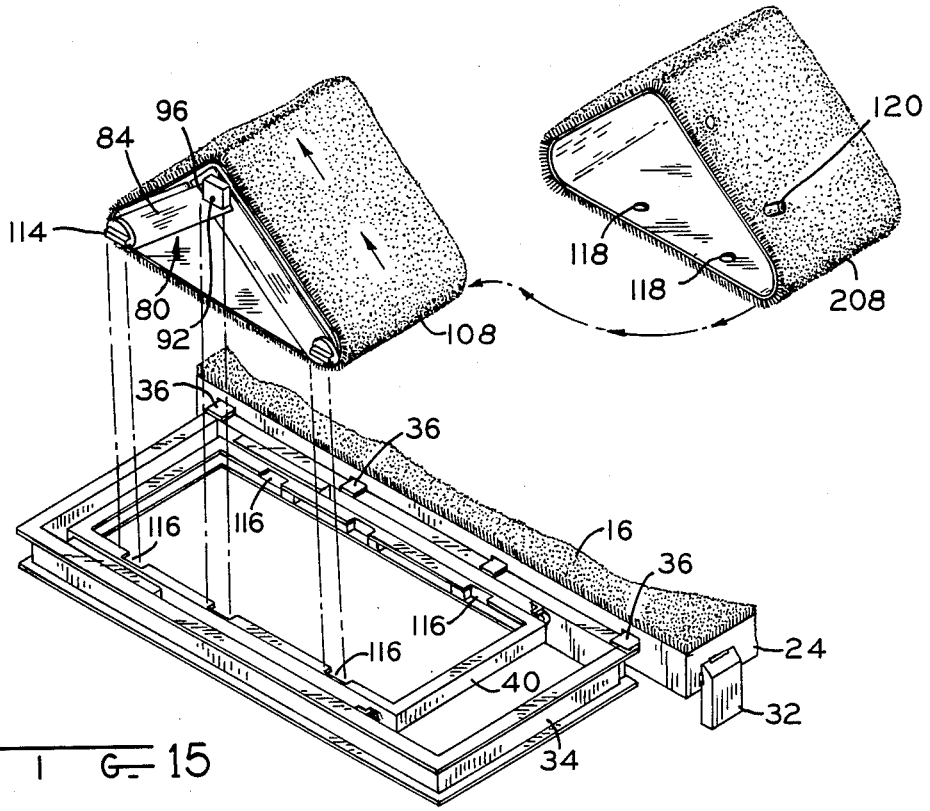
FIG. 15 is a perspective, partially exploded, view of a portion of the golf practice apparatus of FIG. 1, namely the fairway turf simulating component, and also showing an alternative belt embodiment.

Referring in particular to FIG. 15, it is illustrated how tray 80 can be folded upwardly about its hinge pins 92 and 94 thereby relieving the tension on belt 108. This also allows tubular members 104 and 106 to be displaced toward one another such that they align with respective slots 116 in the top of inner frame 40 thereby allowing tray 80 and belt 108 to be lifted vertically and removed from inner frame 40. When tray 80 is in the folded configuration of FIG. 15, belt 108 is so slackened as to permit it to be slid transversely off the end of tubular members 104 and 106 whereupon it can be replaced by another belt. Also when tray 80 is in the folded position and belt 108 is slackened it is possible to manually rotate belt 108 in the direction of the arrows without hindrance by pins 117 in order to bring up a fresh portion of the belt once the previously exposed portion has become worn. Also illustrated in FIG. 15 is an alternative belt 208 which differs from belt 108 in that it includes a plurality of longitudinally arranged apertures 118 therethrough. Apertures 118 receive and support a rubber tee 120 which allows the present apparatus to be used for practicing wood shots as well as iron shots.

Figure 16:
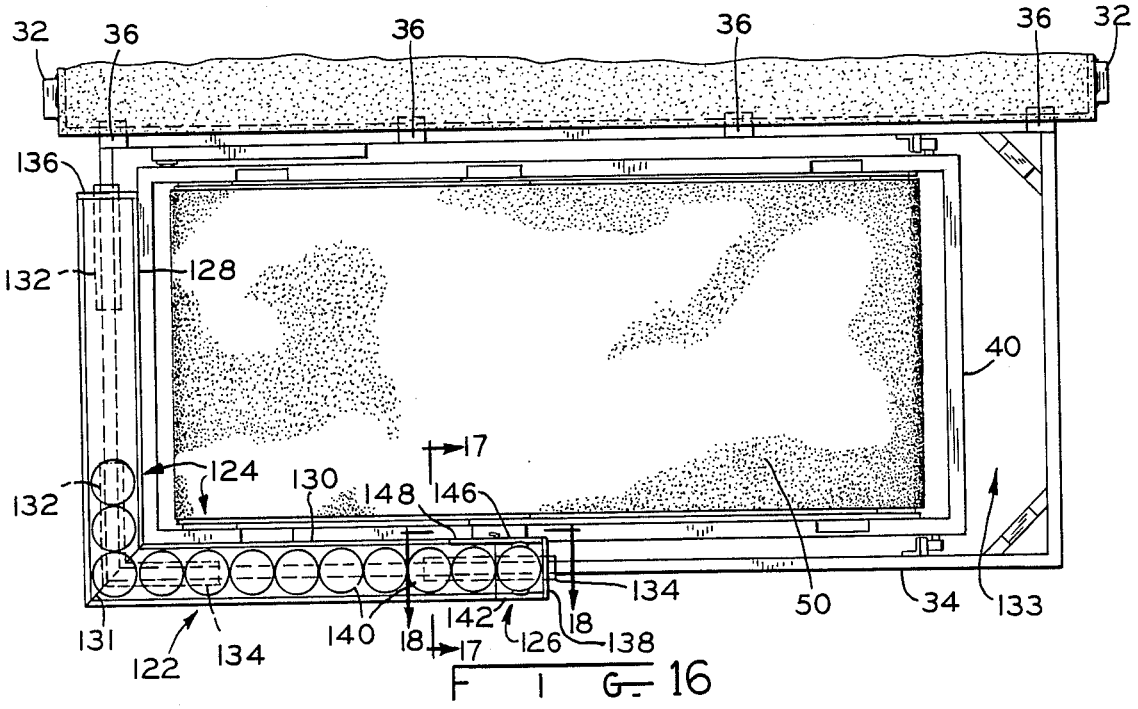
FIG. 16 is a plan view of a portion of the golf practice apparatus of FIG. 1 and showing in particular a ball storage ramp.
Figure 17:
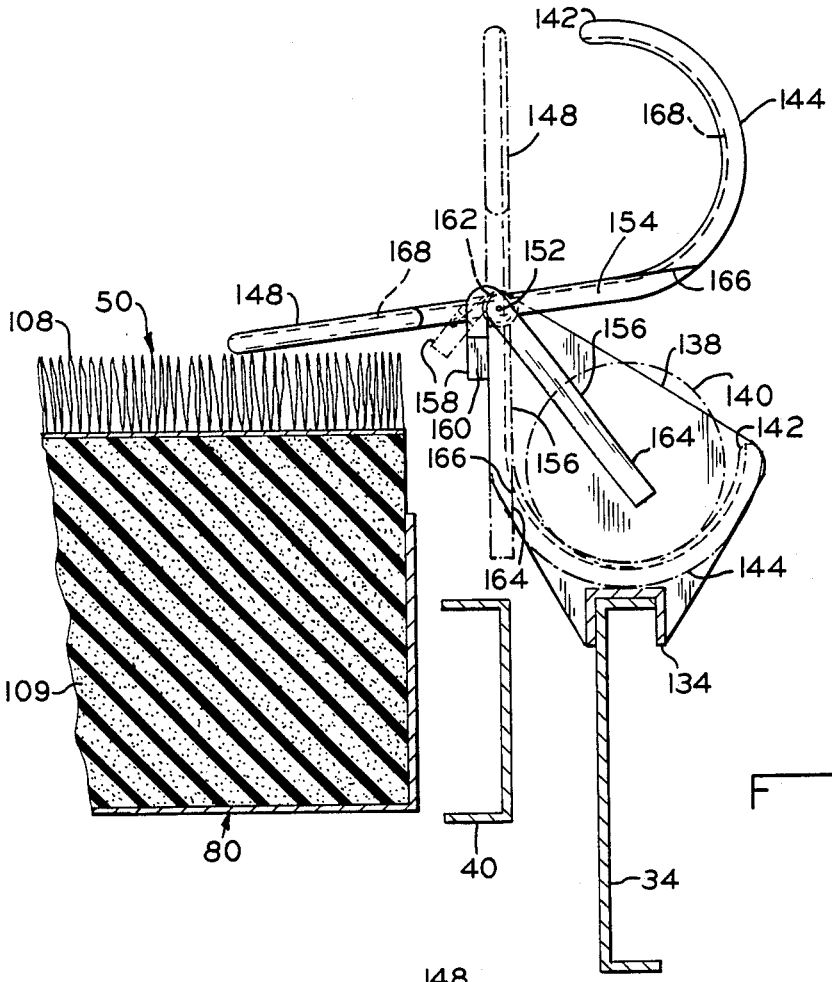
FIG. 17 is a sectional view of the golf practice apparatus shown in FIG. 16 taken along section line 17—17 and looking in the direction of the arrows.
Figure 18:
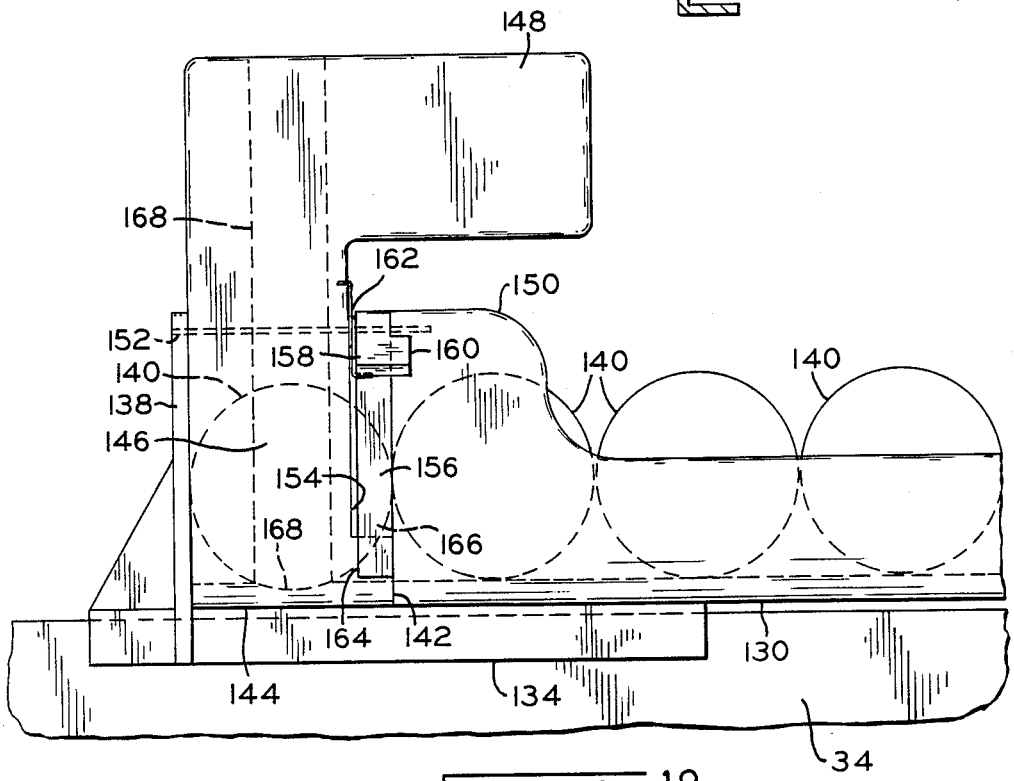
FIG. 18 is a sectional view of the golf practice apparatus shown in FIG. 16 taken along section line 18—18 and looking in the direction of the arrows.

Referring in particular to FIGS. 16–18, there is illustrated a ball storage ramp 122 having a reservoir area 124 for holding a plurality of golf balls. Ball storage ramp 122 slopes downwardly from the reservoir area 124 toward the low point 126 from which a ball can be placed upon turf simulating upper surface 50 with the aid of golf club head 22, as described below. This allows the golfer to hit a sequence of shots without having to stoop and place the ball onto the surface 50 between each shot.

Ball storage ramp 122 includes two half-round troughs 128 and 130 opening upwardly and having downwardly opening U-shaped channels 132 and 134, respectively, affixed to the bottom surface of each trough. Troughs 128 and 130 are separable from one another but are advantageously abutted at miter 131 when attached to outer frame 34. This two-piece construction of reservoir area 124 allows each of the troughs 128 and 130 to be stored in storage area 133 between the front end of inner frame 40 and outer frame 34 when golf practice apparatus 10 is folded for storage as in FIGS. 4–6. U-shaped channels 132 and 134 frictionally engage outer frame 34 permitting troughs 128 and 130 to be removably attached thereto. Trough 128 is terminated at the elevated end thereof by end plate 136, and trough 130 is terminated at the low end thereof by end plate 138. The length of troughs 128 and 130 between end plates 136 and 138 is available for storage of a plurality of golf balls 140 which roll downhill from end plate 136 to end plate 138 as the first ball adjacent end plate 138 is placed onto surface 50, as described below.

Trough 130 is provided with a pivotally mounted ball lifter 142 adjacent end plate 138 which can be actuated by golf club head 22 to lift a golf ball located thereon upwardly such that the golf ball rolls onto surface 50.

Ball lifter 142 includes a lower half-round portion 144 of like radius as trough 130, and further includes an integral upwardly extending back portion 146 having a horizontally extending wing portion 148. Lifter 142 is pivotally mounted between end plate 138 and an upwardly extending back portion 150 of trough 130 by hinge pin 152. A portion 154 of lower half-round portion 144 and back portion 146 of lifter 142 is offset in the longitudinal direction from back portion 150 and channel 130. Disposed between portion 154 and back portion 150 is a stop bar 156 which is pivotally mounted on hinge pin 152.

Stop bar 156 has an integral extension 158 which extends rearwardly of back portion 150 at an angle of about 45° with respect to stop bar 156. Protruding horizontally from extension 158 is a stop tab 160 which can engage the back surface of back portion 150 to prevent displacement of stop bar 156 beyond a point at which stop bar 156 is oriented at about a 45° angle with respect to back portion 150. Stop bar 156 is therefore pivotable about hinge pin 152 within an arc subtending about 45° from vertical. Lifter 142, on the other hand, is free to pivot about hinge pin 152 within an arc subtending somewhat in excess of 90° from vertical.

Stop bar 156 is biased toward lifter 142 by spiral spring 162 which urges lower end 164 of stop bar 156 into abutting engagement with surface 166 of lifter 142. Consequently, when lifter 142 is caused to pivot about pivot pin 152 from its vertical at-rest orientation, stop bar 156 pivots likewise in constant engagement therewith until tab 160 engages portion 150 at which point stop bar 156 is restrained from further pivotal displacement. As lifter 142 continues to be caused to pivot about pivot pin 152, spring 162 merely winds tighter, providing spring bias against which lifter 142 is urged. As lifter 142 is returned to its original position, stop bar 156 remains at its 45° orientation until surface 166 of lifter 142 again engages surface 164 of stop bar 156, at which time stop bar 156 travels back to its original position in constant engagement with lifter 142.

In use, golfer 14 uses club head 22 to pull wing portion 148 toward surface 50, which causes lifter 142 to pivot, lifting a golf ball located therein upward. Since the uphill sides of lower portion 144 and stop bar 156 are disposed approximately at the point of contact between the first golf ball within lifter 142 and the next ball in line in trough 130, the next ball is restrained by lower portion 144 and stop bar 156 from rolling toward end plate 138 as lifter 142 pivots. Once lower portion 144 has moved beyond the center axis of the next ball (approximately 45°), the next and subsequent balls are restrained by stop bar 156 alone. The ball within lifter 142 continues to be raised until lifter 142 has pivoted approximately 90°, at which time the golf ball therein rolls down back portion 146 onto surface 50. A shallow groove 168 in lower portion 144 and back portion 146 aids the golf ball in rolling in a straight path onto surface 150. Wing 148 can then be released from club head 22, whereupon lifter 142 returns to its original position, urged by spring 162 and gravity for the first approximately 45° of return travel and thereafter by gravity alone. The next golf ball in line in trough 130 then rolls into lifter 142 and the process can be repeated.

Figure 19:
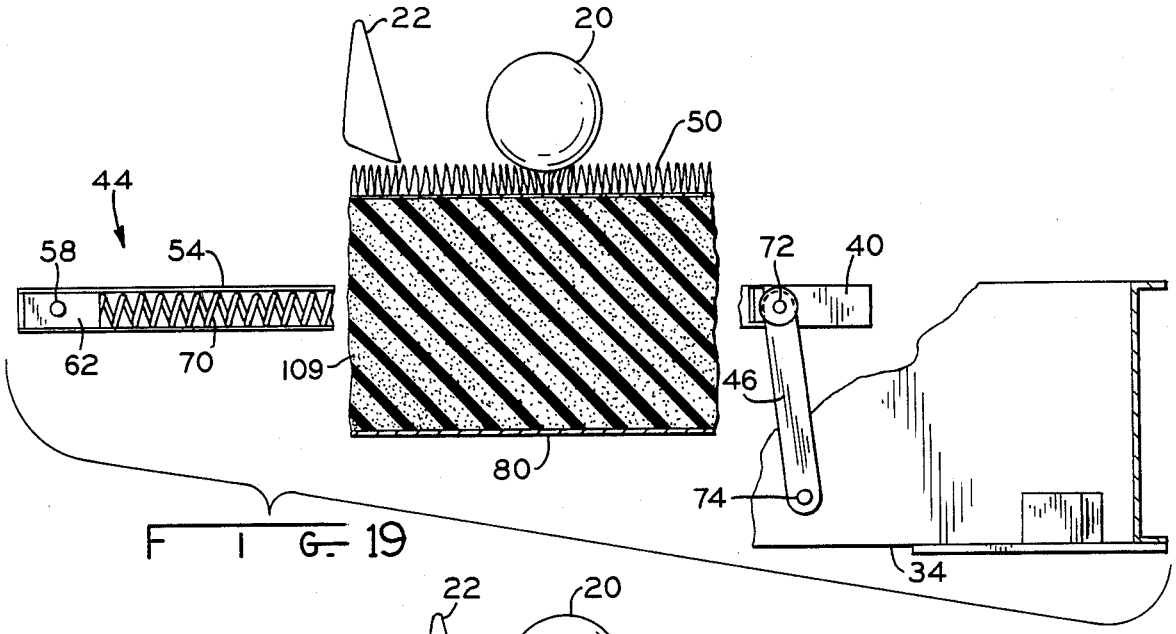
FIGS. 19–23 show the movement of portions of the golf practice apparatus of FIG. 1 in sequence under the influence of the impact of a golf club head thereon with reference to a golf 20 ball place thereon.
Figure 20:
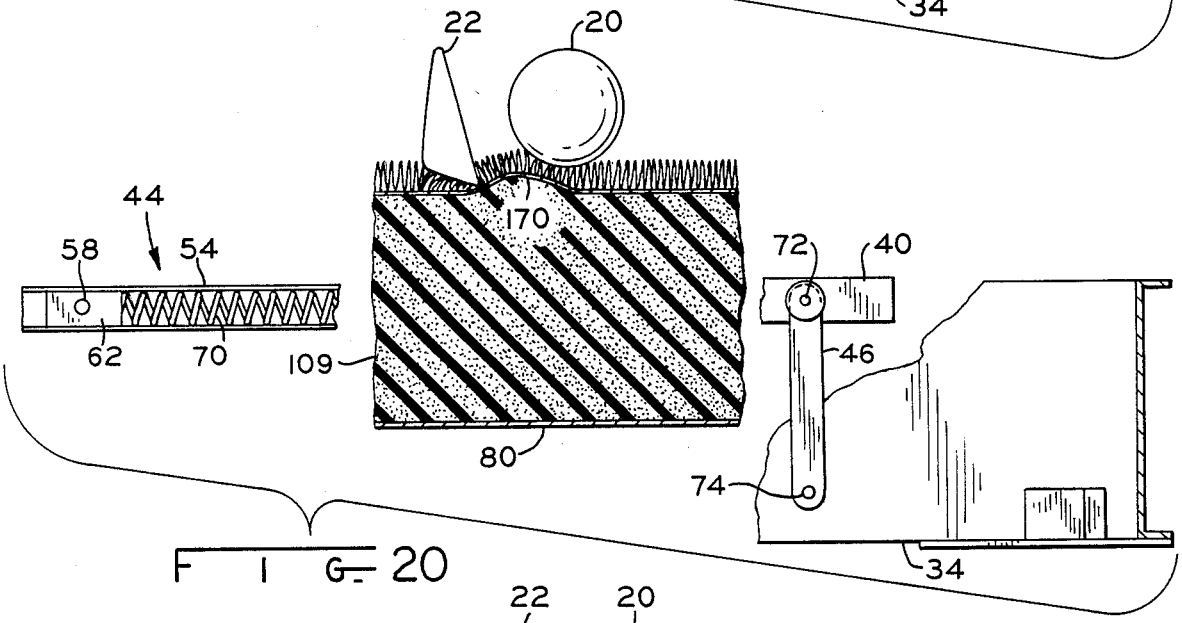
Figure 21:
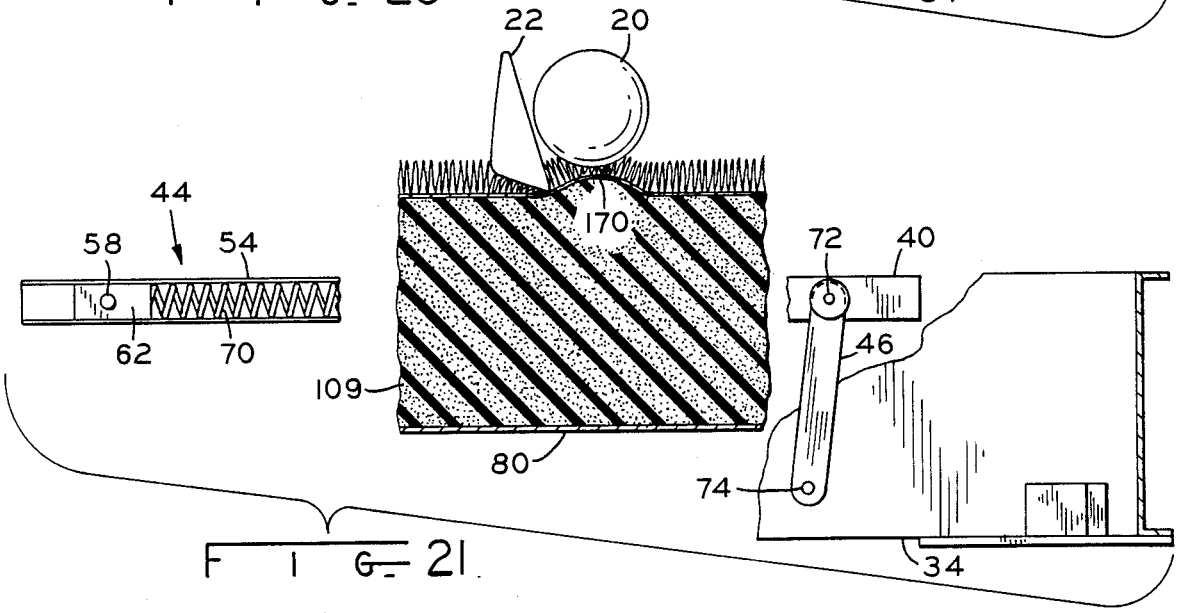
Figure 22:
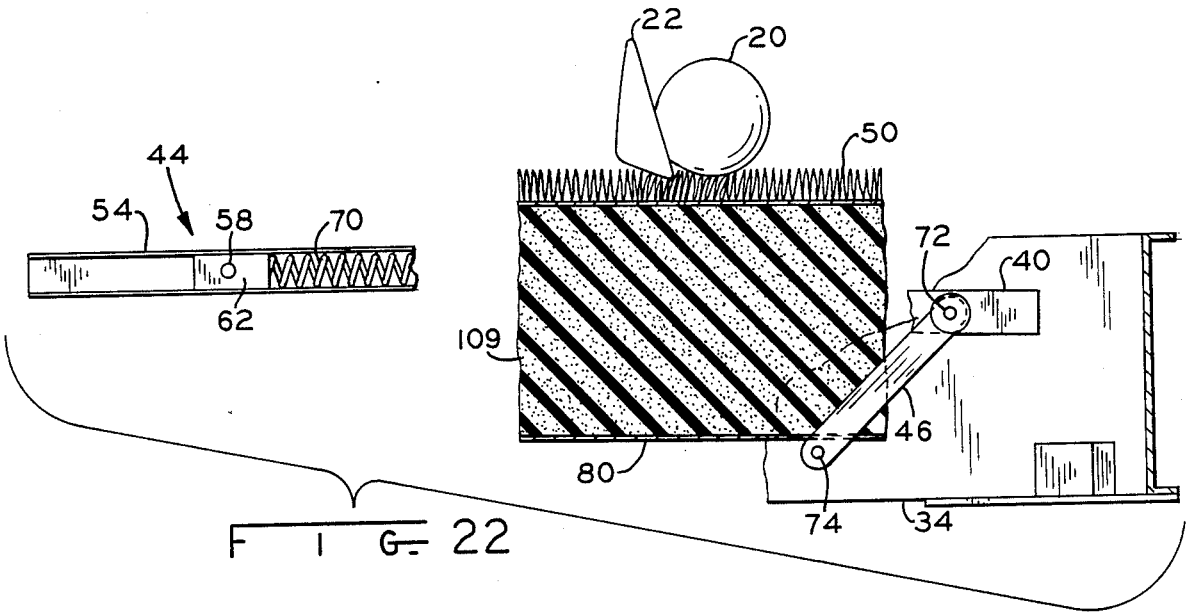
Figure 23:
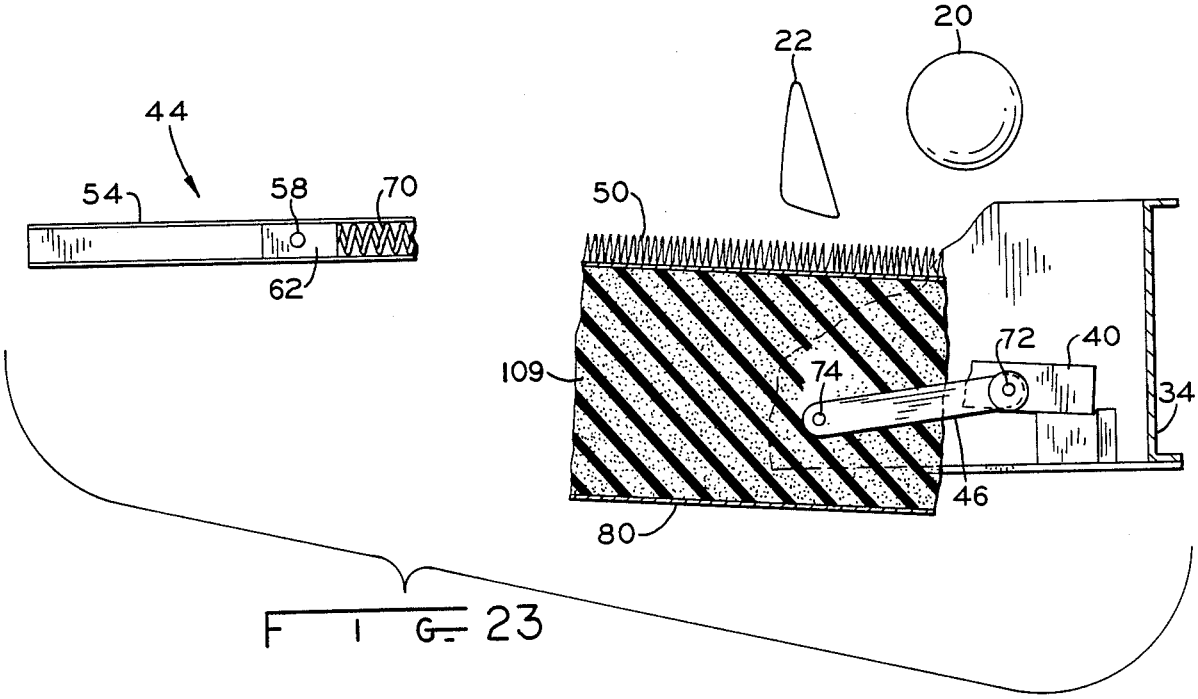

Referring in particular to FIGS. 19–23, the motion of inner frame 40 and surface 50 is shown sequentially as a "fat shot" is executed, with the positions of spring loaded hinge 44 and hinge arm 46 shown in particular with respect to the position of the club head 22 vis-a-vis ball 20 and turf surface 50. In FIG. 19 the golf ball 20 is shown at rest on surface 50 with club head 22 descending downwardly and to the right. It can be seen that golf club head 22 is about to contact surface 50 somewhat behind ball 20 with the relative position of the club head with respect to the ball being representative of a "fat shot". In FIG. 20, club head 22 has impacted and engaged surface 50 with the downward and forward directional components of club head 22 causing a small portion of the surface 50 just behind ball 20 to be pushed up forming a wrinkle 170 which contacts ball 20 prior to club head 22 contacting ball 20. The formation of wrinkle 170 is aided by the fact that inner frame 40 cannot initially translate downwardly at first impact of club 22 therewith and belt 108 cannot translate forwardly except against the resistance of compression spring 70. In FIG. 21, club head 22 has advanced forwardly sufficiently such that it is about to contact ball 20. The horizontal velocity component of club head 22 has been reduced as a result of the shot being "fat" and a portion of its energy being dissipated in creating wrinkle 170. In FIG. 22, club head 22 has contacted ball 20 and the forward translation of inner frame 40 has reached a point where the forward end has begun to move downwardly in an arcuate path so as to get out of the way of club head 22 on the follow-through during which a divot would normally be taken on natural turf. In FIG. 23, ball 22 has rebounded from the face of golf club head 22 and surface 50 has dipped down to its full extent providing clearance for club head 22 to follow through without encountering undue resistance from surface 50.

A golfer executing a "fat shot" such as is illustrated in sequence in FIGS. 19–23 will recognize that his shot is poorly executed. This is because of the limited distance that the ball travels due to the loss of energy in creating the wrinkle 170 and the loss of transfer of energy between the club head 22 and the ball 20 caused by wrinkle 170 being interposed therebetween.

It will be appreciated that the foregoing is presented by way of illustration only, and not by way of any limitation, and that various alternatives and modifications may be made to the illustrated embodiment without departing from the spirit and scope of the invention.

What we claim is:

1. A golf practice apparatus for simulating the response of natural turf to the impact of a golf club head during a conventional golf club swing, said apparatus comprising:

a main frame;

an inner frame disposed within said main frame, said inner frame having a rearward end and a forward end;

a turf simulating upper surface having a forward end and a rearward end each supported by and corresponding to the forward end and rearward end of said inner frame;

means for biasing said inner frame rearwardly with respect to said main frame;

means for connecting the rearward end of said inner frame to said main frame such that the rearward end can translate forwardly when said upper surface is impacted by said golf club head, wherein the rearward end of said inner frame is pivotally and slidingly connected to said main frame; and means for connecting the forward end of said inner frame to said main frame such that the forward end can translate initially forwardly and thence downwardly in a generally arcuate path when said upper surface is impacted by said golf club head, wherein the forward end is pivotally connected to said main frame via a hinge arm extending downwardly from said inner frame.

2. The golf practice apparatus of claim 1, and further including a platform for supporting a standing person and means for removably connecting said main frame to said platform, said platform being configured as a closeable hinged case sized to receive said main frame therein when closed.

3. The golf practice apparatus of claim 1 and further including a ball storage ramp adjacent said upper surface, said ball storage ramp including a reservoir area sloping generally downwardly to a lowest point; and a ball lifter means hinged to said ball storage ramp by a hinge proximate the lowest point for receiving and lifting a golf ball above said upper surface and delivering the golf ball onto said upper surface, said ball lifter means actuable by a golf club head, said ball lifter means including a lower ball receiving portion and an integral upwardly extending back portion extending above the hinge such that as said ball lifter means is rotated about the hinge by the golf club, the golf ball is lifted above the hinge and thereafter rolls down the back portion onto said upper surface.

4. The golf practice apparatus of claim 1, in which said upper surface includes a belt, and further including means for maintaining the belt taut.

5. The golf practice apparatus of claim 4, in which said means for maintaining the belt taut includes a forward member and a rearward member in engagement with the forward end and the rearward end of the belt, respectively, and means for biasing the forward member and the rearward member apart.

6. The golf practice apparatus of claim 5, and further including a resilient pad disposed below said upper surface.

7. The golf practice apparatus of claim 5, in which the belt is a continuous loop and the forward member and the rearward member are disposed within the belt loop.

8. The golf practice apparatus of claim 7, and further including means for preventing rotation of at least one of the forward and rearward members.

9. The golf practice apparatus of claim 7, in which the means for biasing the forward member and the rearward member apart includes a longitudinal member disposed therebetween, the longitudinal member including a spring attached thereto and engaging at least one of the forward and rearward members.

10. The golf practice apparatus of claim 9, in which the longitudinal member is a tray open at the top, and further including a resilient pad disposed within the tray below said upper surface.

11. The golf practice apparatus of claim 9, in which the longitudinal member includes hinge means permitting folding of the longitudinal member.

12. A golf practice apparatus for simulating the response of natural turf to the impact of a golf club head during a conventional golf club swing, said apparatus comprising:

a main frame;

an inner frame having a forward end and a rearward end, said inner frame disposed within said main frame, said inner frame carrying an upper surface, the rearward end being pivotally and slidingly connected to said main frame, the forward end being pivotally connected to said main frame via a hinge arm extending downwardly from said inner frame; and means for biasing said inner frame rearwardly with respect to said main frame such that the rearward end of said inner frame translates forwardly and the forward end of said inner frame translates initially forwardly and then downwardly in a generally arcuate path when the upper surface is impacted by said golf club head.

13. A golf practice apparatus comprising:

a frame;

a continuous belt loop having a forward end and a rearward end and a horizontally oriented turf simulating upper surface;

means for connecting said belt loop to said frame; and means for maintaining said belt loop taut and including a forward member and a rearward member in engagement with the forward end and the rearward end of said belt loop, respectively, and foldable means for biasing the forward member and the rearward member apart and for selectively unbiasing the forward member and rearward member to permit removal of said belt loop therefrom, said foldable means including a tray open at the top and hinged intermediate of the forward member and the rearward member.

14. A portable golf practice apparatus, comprising:

a platform for supporting a standing person configured as two boxes, each having an open side facing downward, the two boxes hinged together such that the open sides thereof can be pivoted together, whereby said platform is thereby convertible to form a closed case; and a fairway turf simulating component removably attachable to said platform and sized and configured to be stored inside said platform when said platform is configured as a closed case; said fairway turf simulating component including:

a main frame;

an inner frame having a forward and a rearward end, said inner frame disposed within said main frame, said inner frame carrying an upper surface, the rearward end being pivotally and slidingly connected to said main frame, forward end being pivotally connected to said main frame via a hinge extending downwardly from said inner frame; and means for biasing said inner frame rearwardly with respect to said main frame such that the rearward end of said inner frame translates forwardly and the forward end of said inner frame translates initially forwardly and then downwardly in a generally arcuate path when the upper surface is impacted by said golf club head.

15. A golf practice apparatus comprising:

a turf simulating upper surface;

a ball storage ramp adjacent said upper surface, said ball storage ramp including a reservoir area removably attached to said main frame and sloping generally downwardly to a lowest point; and a ball lifter means hinged to said ball storage ramp by a hinge proximate the lowest point for receiving and lifting a golf ball above said upper surface and delivering the golf ball onto said upper surface, said ball lifter means actuable by a golf club head, said ball lifter means including a lower ball receiving portion and an integral upwardly extending back portion extending above the hinge such that as said ball lifter means is rotated about the hinge by the golf club, the golf ball is lifted above the hinge and thereafter rolls down the back portion onto said upper surface.

16. A golf practice apparatus of claim 15, and further including:

a main frame;

an inner frame having a forward end and a rearward end, said inner frame disposed within said main frame, said inner frame carrying said upper surface, the rearward end being pivotally and slidingly connected to said main frame, the forward end being pivotally connected to said main frame via a hinge arm extending downwardly from said inner frame; and means for biasing said inner frame rearwardly with respect to said main frame such that the rearward end of said inner frame translates forwardly and the forward end of said inner frame translates initially forwardly and then downwardly in a generally arcuate path when the upper surface is impacted by said golf club head.

17. The golf practice apparatus of claim 16, in which the ball lifter means includes stop means for restraining subsequent balls from rolling downhill in the reservoir area while the first ball is being lifted.

* * * * *